US010934671B2

(12) United States Patent
Dunyak

(10) Patent No.: US 10,934,671 B2
(45) Date of Patent: Mar. 2, 2021

(54) ANIMAL WASTE POUCH

(71) Applicant: Jean Irene Dunyak, Raleigh, NC (US)

(72) Inventor: Jean Irene Dunyak, Raleigh, NC (US)

( * ) Notice: Subject to any disclaimer, the term of this patent is extended or adjusted under 35 U.S.C. 154(b) by 0 days.

(21) Appl. No.: 16/504,212

(22) Filed: Jul. 5, 2019

(65) Prior Publication Data

US 2020/0018028 A1 Jan. 16, 2020

Related U.S. Application Data

(60) Provisional application No. 62/694,437, filed on Jul. 5, 2018.

(51) Int. Cl.
*E01H 1/12* (2006.01)

(52) U.S. Cl.
CPC ... *E01H 1/1206* (2013.01); *E01H 2001/1286* (2013.01)

(58) Field of Classification Search
CPC ..... E01H 1/1206; E01H 2001/122; E01H 2001/1273; E01H 2001/128; E01H 2001/1286; A01K 23/005; A01K 27/008
USPC ..... 294/1.3; 150/118; 206/549
See application file for complete search history.

(56) References Cited

U.S. PATENT DOCUMENTS 4,739,809 A * 4/1988 Adams ..... A45C 3/00 150/112
5,718,192 A * 2/1998 Sebastian ..... A01K 27/006 119/795
6,085,695 A * 7/2000 Miller ..... A01K 27/006 119/795
6,237,533 B1 * 5/2001 Rodriguez ..... A01K 27/006 119/161
6,257,473 B1 7/2001 Ringelstetter
9,565,836 B2 * 2/2017 Conley ..... A01K 27/008
9,861,078 B1 * 1/2018 Mantelli ..... A01K 27/008
2004/0200438 A1 * 10/2004 Jeffrey ..... A01K 27/006 119/858
2009/0151645 A1 * 6/2009 Fangsrud ..... B65F 1/062 119/161
2009/0315350 A1 * 12/2009 Allen ..... E01H 1/1206 294/1.3
2011/0011504 A1 * 1/2011 Steinbacher ..... A01K 27/006 150/106
2011/0239957 A1 10/2011 Washington
2012/0286003 A1 * 11/2012 Shadday ..... E01H 1/1206 224/191
2016/0052712 A1 * 2/2016 Jackson-Tyree ..... E01H 1/1206 294/1.3
2017/0002531 A1 * 1/2017 Byham ..... E01H 1/1206
2017/0101753 A1 * 4/2017 Levitt ..... A01K 27/008

* cited by examiner

*Primary Examiner* — Dean J Kramer
(74) *Attorney, Agent, or Firm* — Runyan Law; Charles Runyan

(57) ABSTRACT

An animal waste storage pouch; the animal waste storage pouch includes a pouch-body, a fastening-mechanism and at least one bag. The animal waste storage pouch attaches to a pet collar, leash, harness, etc. and therefore attaches the animal waste storage pouch to a pet. This enables the pet to carry and store bagged waste until a convenient location is reached to dispose of the bagged waste.

19 Claims, 6 Drawing Sheets

ANIMAL WASTE POUCH

CROSS REFERENCE TO RELATED APPLICATION

The present application is related to and claims priority to U.S. Provisional Patent Application No. 62/694,437 filed Jul. 5, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of pet accessories and more specifically relates to a pet waste pouch.

2. Description of Related Art

Numerous devices have been developed to make it easier and more convenient for dog owners to pick up waste from their dogs during walks. Pet owners frequently take their animals for walks in public places. Unfortunately, the pets may defecate during the walk forcing the pet owner to pick up the pet waste in order to comply with local laws. It is common practice for pet owners to use small plastic bags to pick up the pet waste. Many pet owners find that carrying the plastic bags filled with animal waste by hand is unpleasant. A suitable solution is desired.

U.S. Pat. No. 6,257,473 to Nicholas Clement Ringelstetter relates to a sanitary collection holder for animal waste. The described sanitary collection holder for animal waste includes an interior open-topped chamber for holding tied loaded plastic bags containing retrieved pet-waste, the pouch having a flap portion carrying interior and exterior opening pockets on opposite sides thereof, a pair of deep side-pockets on opposite sides of the chamber, releasable retaining loops coupled to the respective deep side-pockets, the interior opening pocket carrying a supply of plastic litter bags and the exterior opening pocket carrying personal effects, releasable retainer loops coupled to the deep side-pockets and each formed of a strip carrying opposite sided "hook" and "pile" portions which are engaged to form the loop, "hook" and "pile" portions being self-engageable forming the loops, and pockets on opposite sides thereof. The flap portion carries a horizontal "hook" portion and is fitted over the open interior chamber and engages a "pile" portion applied to the outer wall of the pouch at a location angular to the "hook" portion, the engagement being adjustable at any location along the length of said "pile" portion dependent upon the girth of the pouch.

BRIEF SUMMARY OF THE INVENTION

In view of the foregoing disadvantages inherent in the known pet accessories art, the present disclosure provides a novel animal waste pouch. The general purpose of the present disclosure, which will be described subsequently in greater detail, is to provide a pouch which allows a pet, instead of a pet's owner, to carry and store bagged waste until a convenient location is reached to dispose of the bagged waste. The system may be configured to couple with the end of a pet leash, the leash handle, or a pet harness/collar.

An animal waste storage pouch is disclosed herein. The animal waste storage pouch includes a pouch-body which may include an outer-shell defining an open-top and an inner-capacity and at least one bag-dispensing slot. A fastening-mechanism may be attached to the pouch-body and may include a magnetic-closure. The fastening-mechanism may be configured to attach the pouch-body to the pet walking apparatus and simultaneously substantially close the open-top. Further, at least one bag may be disposed within the inner-capacity about the at least one bag-dispensing slot.

A method of using the animal waste storage pouch is also disclosed herein. The method of using the animal waste storage pouch may comprise the steps of providing the animal waste storage pouch as above; attaching the pouch-body to the pet walking apparatus via the fastening-mechanism; removing the at least one bag from the inner-capacity via the at least one bag-dispensing slot; using the at least one bag to pick up animal waste; unfastening the fastening-mechanism to expose the open-top; placing the at least one bag into the inner-capacity; and re-fastening the fastening-mechanism to close the open-top.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an animal waste pouch, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to pet accessories and more particularly to an animal waste pouch as used to improve the pet waste pouch.

Generally, disclosed is a soft pliable pouch meant to hold dog waste and carried on the leash or pet's collar so that a pet walker may be hands-free. The soft pliable pouch may include a magnetic fastener to retain the pouch in a closed position, and also to attach the pouch to the leash or pet collar.

Depending on a size of the pet, the pouches may be manufactured in extra-small, small, medium, large, and extra-large sizes. The pouch may be constructed from a strong, light weight, waterproof material, with firm seams to hold shape. Directions for use may include to attach the pouch on the leash, at the end of the leash itself, on the leash handle, or if using a harness, on the back of the harness.

Referring now more specifically to the drawings by numerals of reference, there is shown in FIGS. 1-5, various views of an animal waste storage pouch 100.

Figure 1:
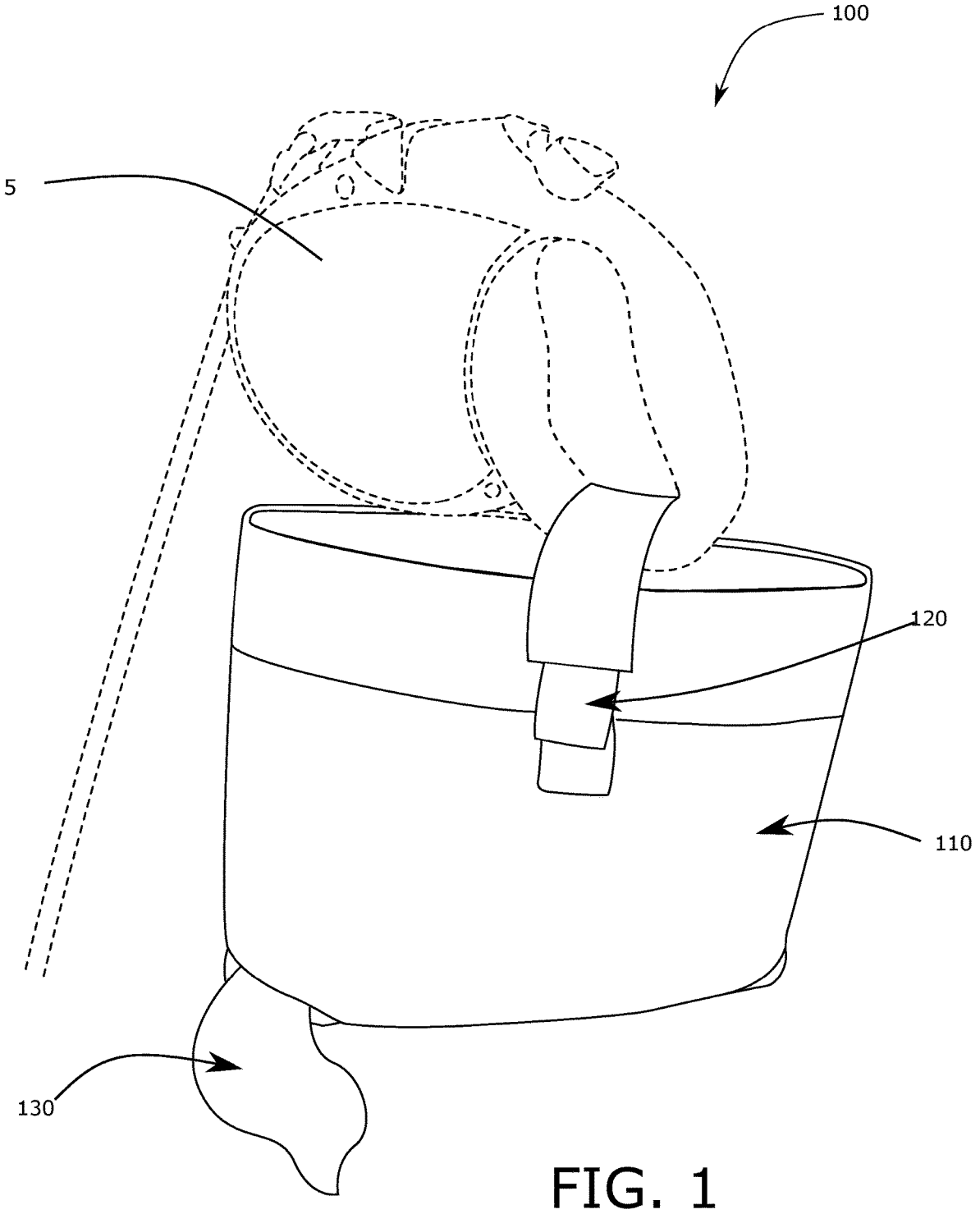
FIG. 1 is a front perspective view of the animal waste storage pouch during an 'in-use' condition, according to an embodiment of the disclosure.

FIG. 1 shows an animal waste storage pouch 100 during an 'in-use' condition, according to an embodiment of the present disclosure. As illustrated, the animal waste storage pouch 100 may include a pouch-body 110, a fastening-mechanism 120 and at least one bag 130. The animal waste storage pouch 100 may be used for attachment to a pet walking apparatus 5, such as a leash, collar or harness.

According to one embodiment, the animal waste storage pouch 100 may be arranged as a kit. The kit may include a set of user instructions. The instructions may detail functional relationships in relation to the structure of the animal waste storage pouch 100 (such that the animal waste storage pouch 100 can be used, maintained, or the like, in a preferred manner).

Figure 2A:
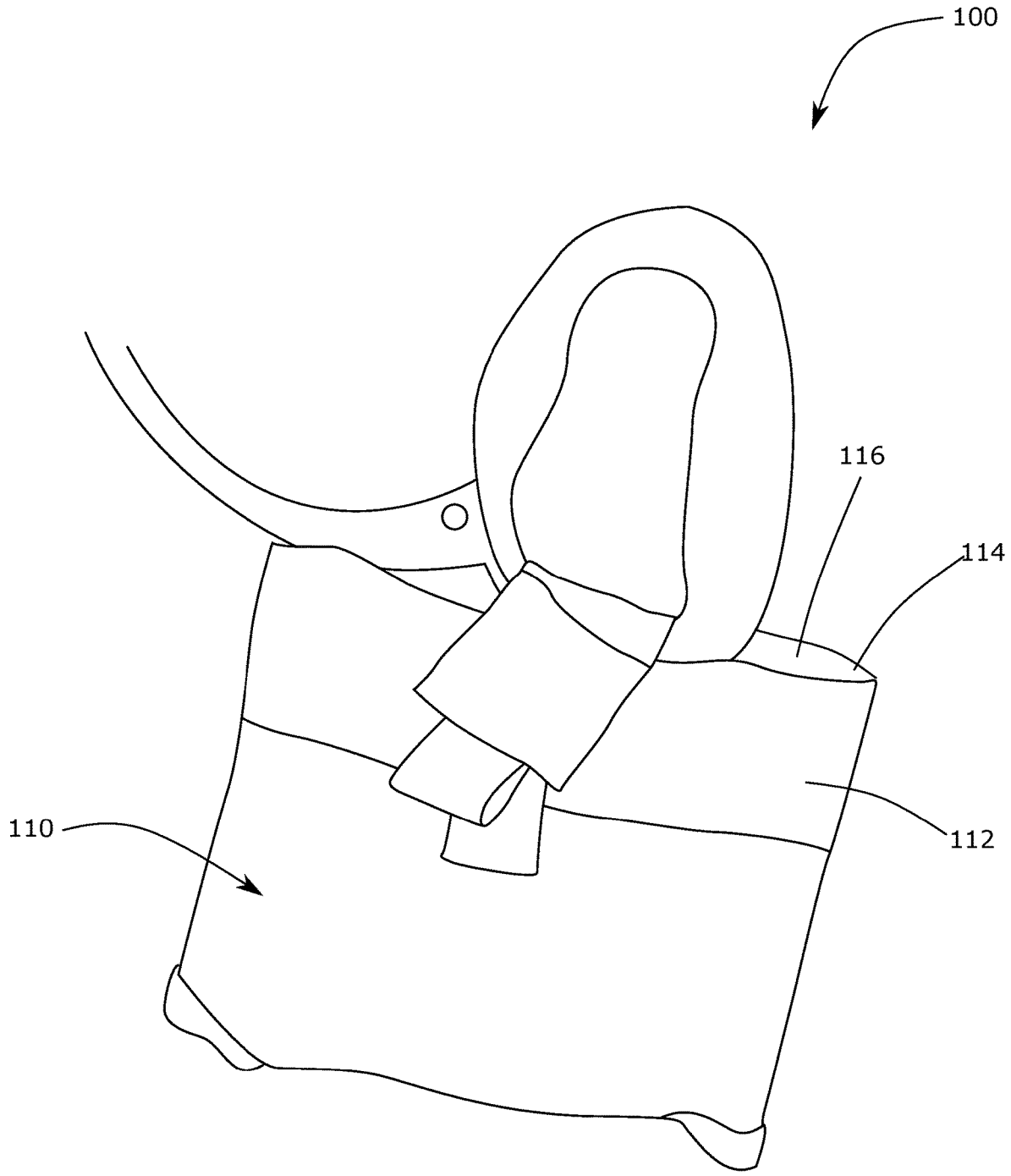
FIG. 2A is a front perspective view of the animal waste storage pouch of FIG. 1, according to an embodiment of the present disclosure.
Figure 2B:
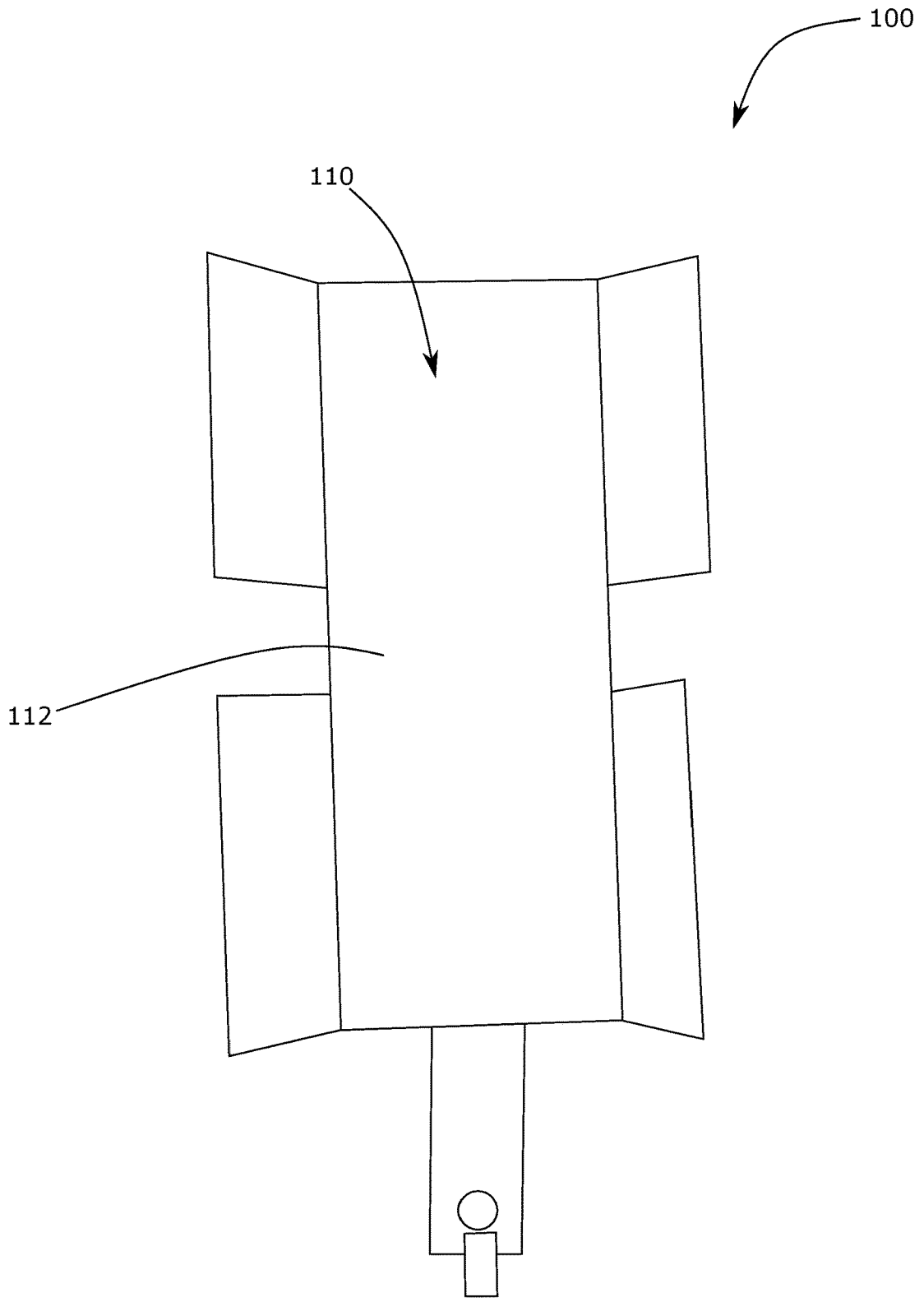
FIG. 2B is a top perspective view of the animal waste storage pouch of FIG. 1, according to an embodiment of the present disclosure.

FIGS. 2A-2B show a front and top perspective views of the animal waste storage pouch 100 of FIG. 1, according to an embodiment of the present disclosure. The pouch-body 110 may include an outer-shell 112 defining an open-top 114 and an inner-capacity 116. In one embodiment, the animal waste storage pouch 100 may be made from a machine washable fabric. The machine washable fabric may be a cotton material. In some embodiments, the material may be canvas. The animal waste storage pouch 100 may be formed and held together via highly durable seams to prevent accidental ripping of the animal waste storage pouch.

In another embodiment, the animal waste storage pouch 100 may be made from a disposable material. Further, the animal waste storage pouch 100 may be made from a bio-degradable material. Preferably, the disposable material may be a paper material. The paper material may be thick paper, card, cardboard, etc.

Figure 3:
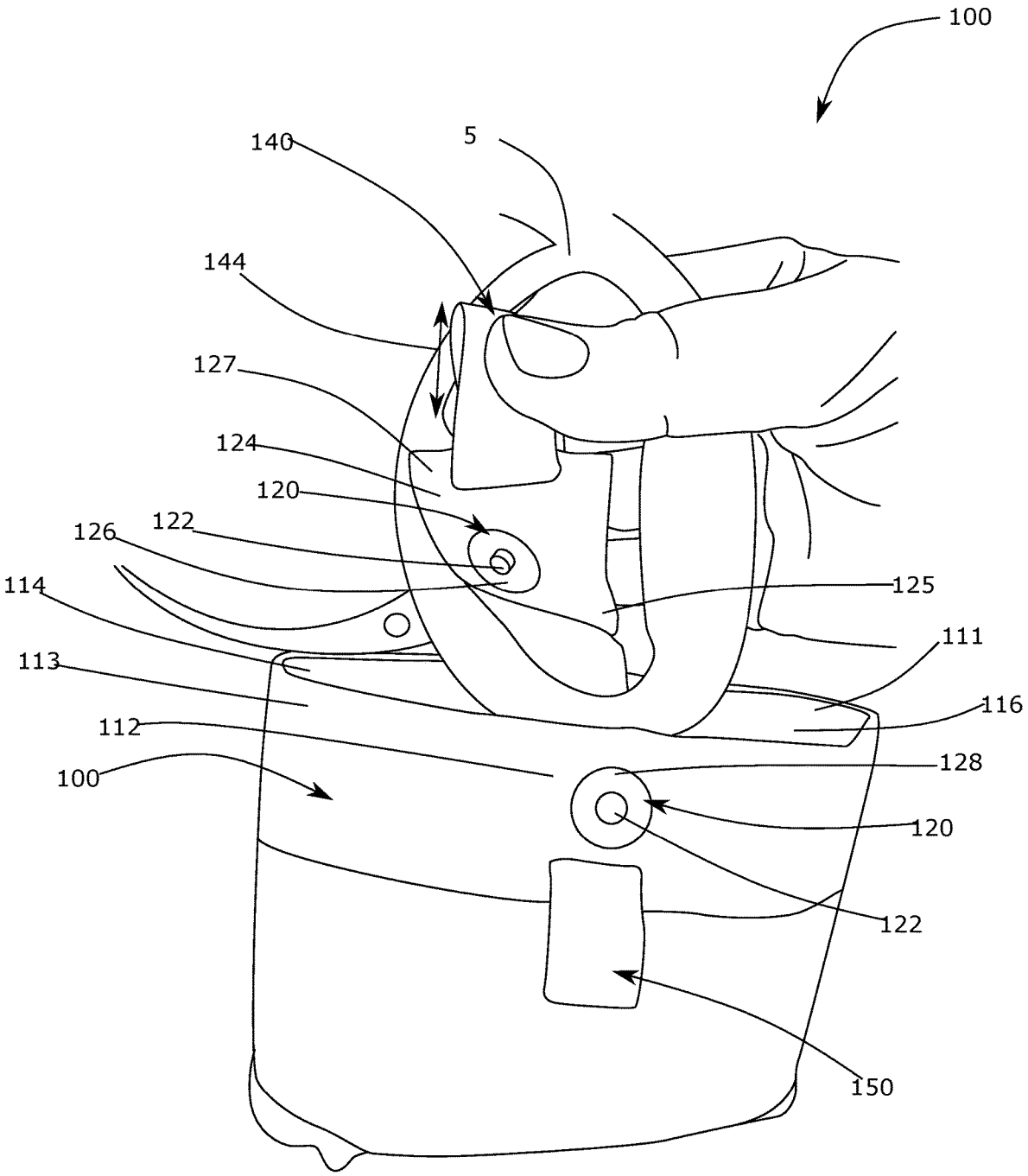
FIG. 3 is a front perspective view of the animal waste storage pouch of FIG. 1, according to an embodiment of the present disclosure.

FIG. 3 shows a front perspective view of the animal waste storage pouch 100 of FIG. 1, according to an embodiment of the present disclosure. The fastening-mechanism 120 may be attached to the pouch-body 110 and may include a magnetic-closure 122. The fastening-mechanism 120 may include a strap 124 attached to a first-side 111 of the outer-shell 112 at a first-end 125 of the strap 124. Further, the magnetic-closure 122 may include a first magnet-fastener 126 and a second magnet-fastener 128.

The strap 124 may include a second-end 127 and the first magnet-fastener 126 may be attached to the second-end 127. The second magnet-fastener 128 may be attached to a second-side 113 of the outer-shell, the second-side 113 being opposite the first-side 111. The first magnet-fastener 126 may be magnetically attracted to the second-magnet fastener. Preferably, the fastening-mechanism 120 may be configured to attach the pouch-body 110 to the pet walking apparatus 5 and simultaneously substantially close the open-top. In one embodiment, the fastening-mechanism 120 may fully close the open-top 114 such that contents of the pouch-body 110 are unable to escape. In other embodiments, the fastening-mechanism 120 may substantially close the open-top 114, such that the second-side 113 of the outer-shell 112 is fastened to the first-side 111 preventing the contents of the pouch-body 110 from easily falling out, but there may be a gap whereby the open-top 112 is not fully closed. The fastening-mechanism 120 may be configured to attach to any pet walking apparatus 5, whether it be a leash, a collar or a harness.

As shown, the animal waste storage pouch 100 may include a first tab 140 attached to the second-end 127 of the strap 124. Similarly, the animal waste storage pouch 100 may further include a second tab 150 attached to the second-side 113 of the outer-shell 112 about the second magnet-fastener 128. The first tab 140 and the second tab 150 may include a substantially looped configuration. The substantially looped configuration may include a loop-diameter 144 sized to receive a finger, such that a user is able to place their finger in the loop-diameter 144 to hold open the pouch-body 110. The user may hold on to the first tab 140 whilst placing a used bag into the inner-capacity 116.

Figure 4:
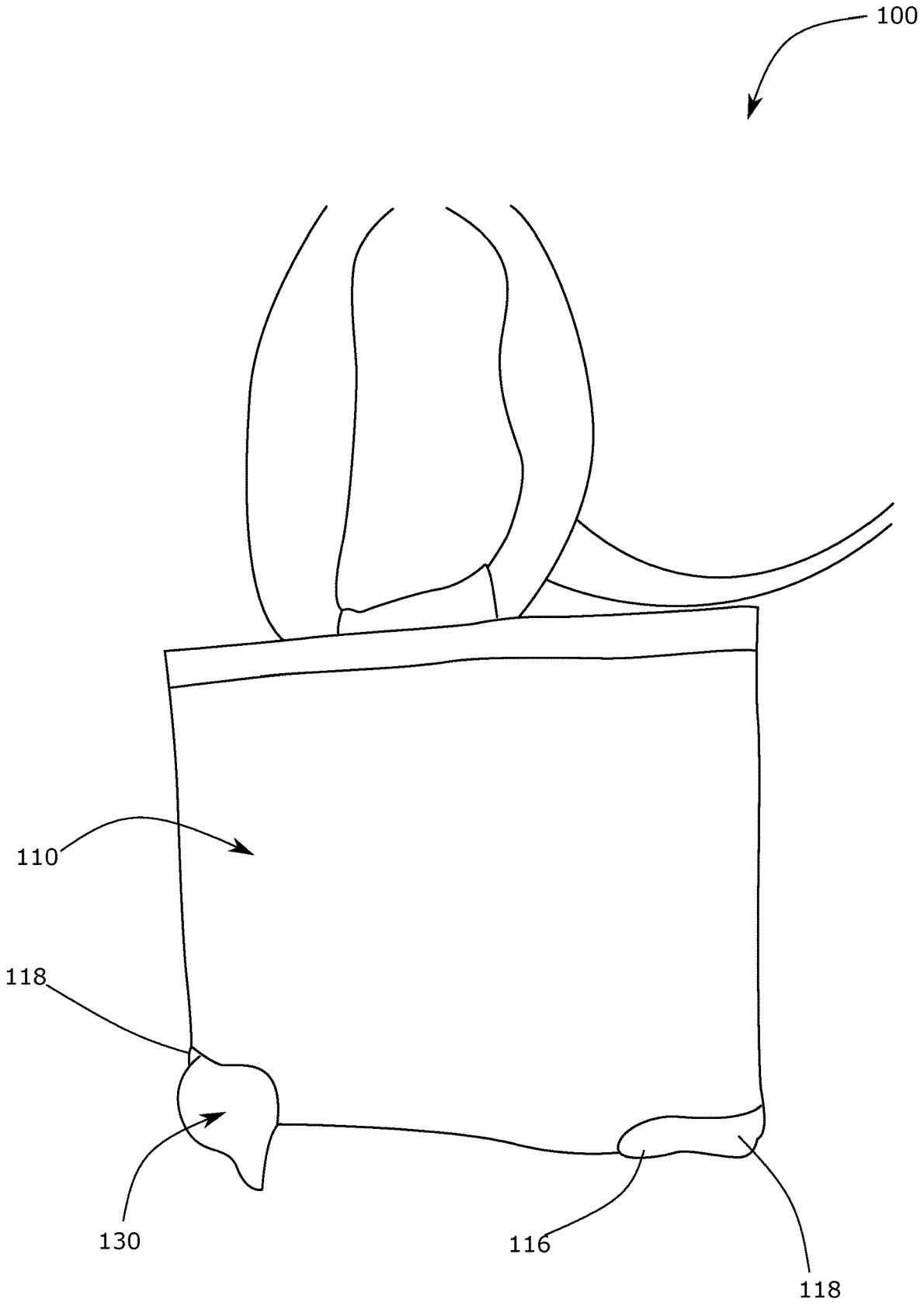
FIG. 4 is a rear perspective view of the animal waste storage pouch of FIG. 1, according to an embodiment of the present disclosure.

FIG. 4 shows a rear perspective view of the animal waste storage pouch 100 of FIG. 1, according to an embodiment of the present disclosure. As shown, the pouch-body 110 may further include at least one bag-dispensing slot 118. The at least one bag 130 may be disposed within the inner-capacity 116 about the at least one bag-dispensing slot 118. The inner-capacity 116 may store a plurality of bags for the user to utilize in picking up pet waste. Preferably, the inner-capacity 116 may be sized to store at least one empty disposable bag and at least one disposable containing animal waste therein simultaneously.

Figure 5:
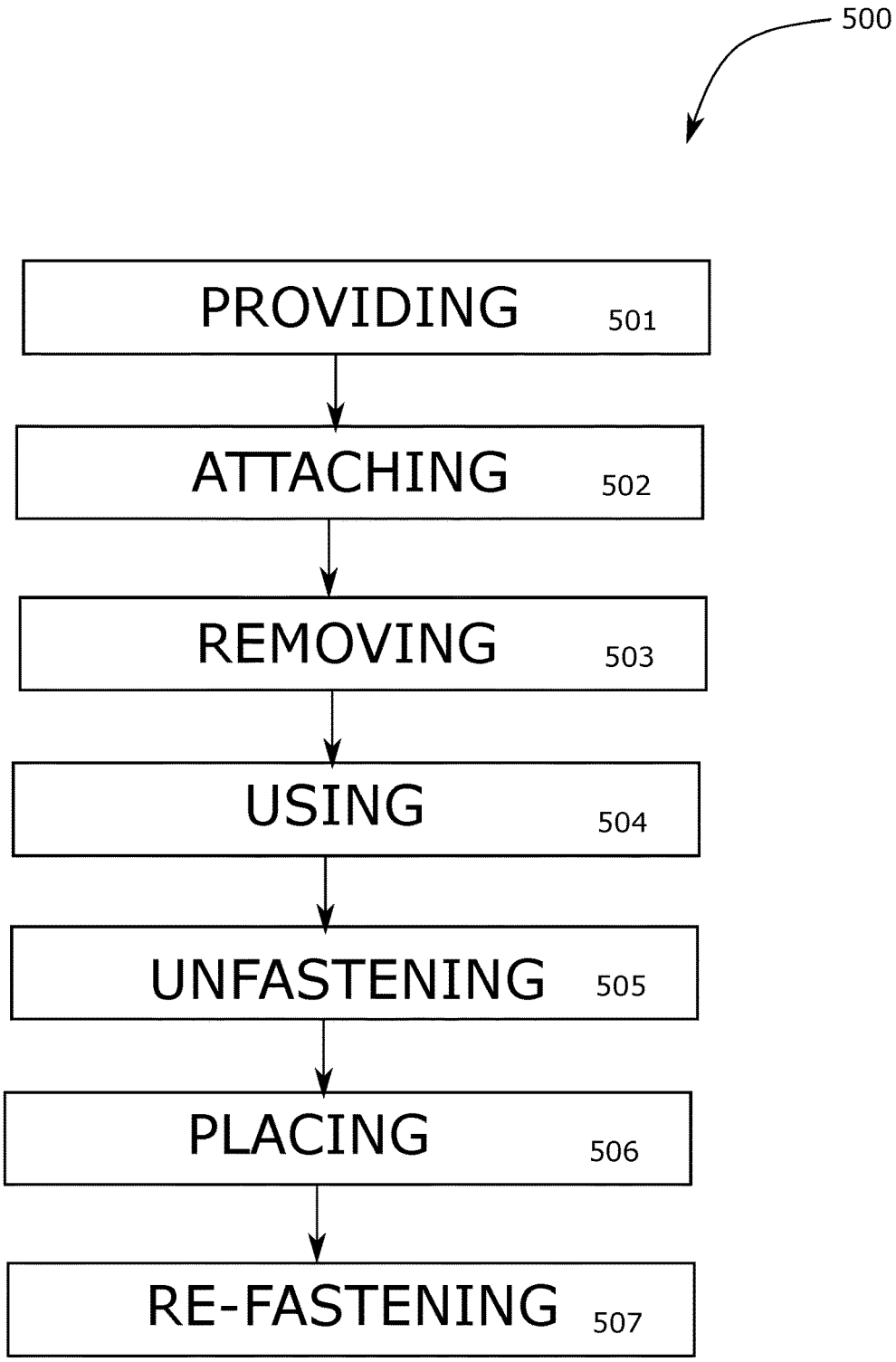
FIG. 5 is a flow diagram illustrating a method of use for the animal waste storage pouch, according to an embodiment of the present disclosure.

FIG. 5 is a flow diagram illustrating a method of using an animal waste storage pouch for attachment to a pet walking apparatus 500, according to an embodiment of the present disclosure. As illustrated, the method of using an animal waste storage pouch for attachment to a pet walking apparatus 500 may include the steps of: a providing 501 the animal waste storage pouch as above; attaching 502 the pouch-body to the pet walking apparatus via the fastening-mechanism; removing 503 the at least one bag from the inner-capacity via the at least one bag-dispensing slot; using 504 the at least one bag to pick up animal waste; unfastening 505 the fastening-mechanism to expose the open-top; placing 506 the at least one bag into the inner-capacity; and re-fastening 507 the fastening-mechanism to close the open-top.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for use of the animal waste storage pouch 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An animal waste storage pouch for attachment to a pet walking apparatus, the animal waste storage pouch comprising:

a pouch-body including an outer-shell defining an open-top and an inner-capacity, the pouch-body further including at least one bag-dispensing slot;

a fastening-mechanism attached to the pouch-body, the fastening-mechanism including a magnetic-closure, the fastening-mechanism configured to attach the pouch-body to the pet walking apparatus and simultaneously substantially close the open-top, and comprising a strap with a first tab attached to a second-end of the strap;

and at least one bag disposed within the inner-capacity about the at least one bag-dispensing slot.

2. The animal waste storage pouch of claim 1, wherein a first-end of the strap attaches to a first-side of the outer-shell.

3. The animal waste storage pouch of claim 2, wherein the magnetic-closure includes a first magnet-fastener and a second magnet-fastener.

4. The animal waste storage pouch of claim 3, wherein the first magnet-fastener is attached to the second-end.

5. The animal waste storage pouch of claim 4, wherein the second magnet-fastener is attached to a second-side of the outer-shell wherein the second-side is opposite the first-side;

and wherein the first magnet-fastener is magnetically attracted to the second magnet-fastener.

6. The animal waste storage pouch of claim 1, further comprising a second tab attached to a second-side of the outer-shell, about a second magnet-fastener.

7. The animal waste storage pouch of claim 6, wherein the first tab includes a substantially looped configuration.

8. The animal waste storage pouch of claim 7, wherein the second tab includes the substantially looped configuration.

9. The animal waste storage pouch of claim 8, wherein the substantially looped configuration includes a loop-diameter sized to receive a finger.

10. The animal waste storage pouch of claim 1, wherein the animal waste storage pouch is made from a machine washable fabric.

11. The animal waste storage pouch of claim 10, wherein the machine washable fabric is a cotton material.

12. The animal waste storage pouch of claim 11, wherein the cotton material is canvas.

13. The animal waste storage pouch of claim 1, wherein the animal waste storage pouch is made from a disposable material.

14. The animal waste storage pouch of claim 13, wherein the disposable material is a paper material.

15. The animal waste storage pouch of claim 1, wherein the animal waste storage pouch is made from a bio-degradable material.

16. The animal waste storage pouch of claim 1, wherein the inner-capacity is sized to store at least one empty disposable bag and at least one disposable bag containing animal waste therein, simultaneously.

17. An animal waste storage pouch for attachment to a pet walking apparatus, the animal waste storage pouch comprising:

a pouch-body including an outer-shell defining an open-top and an inner-capacity, the pouch-body further including at least one bag-dispensing slot;

a fastening-mechanism attached to the pouch-body, the fastening-mechanism including a magnetic-closure, the fastening-mechanism configured to attach the pouch-body to the pet walking apparatus and simultaneously substantially close the open-top, and comprising a strap with a first tab attached to a second-end of the strap;

at least one bag disposed within the inner-capacity about the at least one bag-dispensing slot;

and a second tab attached to a second-side of the outer-shell, about a second magnet-fastener;

wherein a first-end of the strap attaches to a first-side of the outer-shell at a first-end of the strap;

wherein the magnetic-closure includes a first magnet-fastener and a second magnet-fastener;

wherein the first magnet-fastener is attached to the second-end;

wherein the second magnet-fastener is attached to a second-side of the outer-shell;

wherein the second-side is opposite the first-side;

wherein the first magnet-fastener is magnetically attracted to the second magnet-fastener;

wherein the first tab includes a substantially looped configuration;

wherein the second tab includes the substantially looped configuration; and wherein the inner-capacity is sized to store at least one empty bag and at least one bag containing animal waste therein, simultaneously.

18. The animal waste storage pouch of claim 17, further comprising set of instructions and wherein the animal waste storage pouch is arranged as a kit.

19. A method of using an animal waste storage pouch for attachment to a pet walking apparatus, the method comprising the steps of:

providing the animal waste storage pouch including:

a pouch-body including an outer-shell defining an open-top and an inner-capacity, the pouch-body further including at least one bag-dispensing slot;

a fastening-mechanism attached to the pouch-body, the fastening-mechanism including a magnetic-closure, the fastening-mechanism configured to attach the pouch-body to the pet walking apparatus and simultaneously substantially close the open-top, and comprising a strap with a first tab attached to a second-end of the strap; and at least one bag disposed within the inner-capacity about the at least one bag-dispensing slot;

attaching the pouch-body to the pet walking apparatus via the fastening-mechanism;

removing the at least one bag from the inner-capacity via the at least one bag-dispensing slot;

using the at least one bag to pick up animal waste;

unfastening the fastening-mechanism to expose the open-top;

placing the at least one bag into the inner-capacity; and re-fastening the fastening-mechanism to close the open-top.

* * * * *